US005992503A

United States Patent [19]

Knudsen et al.

[11] Patent Number: 5,992,503

[45] Date of Patent: Nov. 30, 1999

[54] SYSTEMS AND METHODS FOR MAINTAINING EFFECTIVE INSULATION BETWEEN COPPER SEGMENTS DURING ELECTROSLAG REFINING PROCESS

[75] Inventors: Bruce Alan Knudsen, Amsterdam; Robert John Zabala, Schenectady; Mark Gilbert Benz, Burnt Hills; William Thomas Carter, Jr., Galway, all of N.Y.

[73] Assignee: General Electric Company, Schenectady, N.Y.

[21] Appl. No.: 08/957,007

[22] Filed: Oct. 23, 1997

Related U.S. Application Data

[63] Continuation-in-part of application No. 08/576,792, Dec. 21, 1995, abandoned.

[51] Int. Cl.[6] ..... B22D 23/10; C22B 9/18; B22F 9/08

[52] U.S. Cl. ..... 164/513; 164/515; 75/10.24; 266/201; 373/156

[58] Field of Search ..... 164/470, 471, 164/493, 497, 507, 509, 513, 515; 75/10.24, 10.11; 266/201, 202; 373/72, 78, 79, 115, 156

[56] References Cited

U.S. PATENT DOCUMENTS 4,873,698 10/1989 Boen ..... 373/156
5,160,532 11/1992 Benz et al. ..... 75/10.24
5,193,607 3/1993 Demukai et al. ..... 164/493

FOREIGN PATENT DOCUMENTS 63-145703 6/1988 Japan .

*Primary Examiner*—Kuang Y. Lin
*Attorney, Agent, or Firm*—Ernest G. Cusick; Noreen C. Johnson

[57] ABSTRACT

Systems and methods of electroslag refining of metal include the introduction of unrefined metal into an electroslag refining process in which the unrefined metal is first melted at the upper surface of the refining slag. The molten metal is refined as it passes through the molten slag. The refined metal is collected in a cold hearth apparatus having a skull of refined metal formed on the surface of the cold hearth for protecting the cold hearth from the leaching action of the refined molten metal. A cold finger bottom pour spout is formed at the bottom of the cold hearth to permit dispensing of molten refined metal from the cold hearth. The cold finger bottom pour spout comprises a plurality of copper segments having gaps. The gap between the segments is established and maintained by insulation structure and sealing structure positioned in each gap.

8 Claims, 5 Drawing Sheets

SYSTEMS AND METHODS FOR MAINTAINING EFFECTIVE INSULATION BETWEEN COPPER SEGMENTS DURING ELECTROSLAG REFINING PROCESS

This application is a continuation-in-part application of U.S. Ser. No. 08/576,792 filed Dec. 21, 1995.

BACKGROUND OF THE INVENTION

The present invention relates generally to an ESR-CIG system. The ESR portion is an electroslag refining apparatus and the CIG portion is a cold wall induction guide tube apparatus, also referred to herein as a cold wall induction guide mechanism and a cold finger nozzle mechanism. More particularly, the invention relates to the design of the copper funnel portion of the CIG. Most particularly, the invention relates to the maintenance of an insulation gap between the individual copper segments that make up the CIG.

Maintenance of the insulation gaps between copper segments is important to the effectiveness of the induction heating system in accomplishing the numerous applications that can be made of the refining apparatus including atomization processing and relate generally to direct processing of metal passing through an electroslag refining operation. One example of molten metal refining is referred to as electroslag refining, and is illustrated and described in U.S. Pat. No. 5,160,532—Benz et al, assigned to the same assignee as the present invention, the disclosure of which is hereby incorporated by reference.

In an electroslag process, a large ingot of a preferred metal may be effectively refined in a molten state to remove important impurities such as oxides and sulfides that may have been present in the ingot. Simply described, electroslag refining comprises positioning a metal ingot over a pool of molten material in a suitable vessel or furnace where the molten material pool may include a surface layer of solid slag, an adjacent underlayer of molten slag and a lowermost body of refined molten ingot metal. The ingot is connected as an electrode in an electrical circuit including the molten metal pool, a source of electrical power and the ingot. The ingot is brought into contact with the molten slag layer and an electrical current is caused to flow across the ingot/molten slag interface.

This arrangement and process provide electrical resistance heating of the slag and melting of the ingot at the noted interface with the molten ingot metal passing through the molten slag layer as a refining medium to become a part of the body of refined ingot metal. It is the combination of controlled resistance melting and passage of the molten ingot metal through the molten slag layer that refines the ingot metal to remove impurities such as oxides, sulfides, and other undesirable inclusions.

However, one component of the ESR/CIG melting system is the copper funnel that forms the walls of the cold-walled-induction guide which comprises several copper segments that result from slotting an otherwise axisymmetric funnel, the slots being added to avoid melting the copper funnel itself as a result of the surrounding induction coils which provide for the penetration of the electric field throughout the funnel and into the liquid metal in the cold-walled-induction guide. The copper funnel has been found to experience a high level of thermal and mechanical strain related to the onrush of liquid metal that occurs when the ESR-CIG system is started. This thermal and mechanical strain has resulted in liquid metal flowing between the several copper segments the cold-induction guide when it has solidified as "fins." These "fins," in addition to causing a short-circuit of the insulation gap, apply extensive force to the vertical walls of the segments resulting in decreased useful life thereof.

Thus, it is important to develop methods and systems for maintaining the insulation gaps between copper segments in order to prevent liquid metal from flowing between the segments and solidifying as fins. Such methods and systems should at least reduce if not eliminate the solidifying of liquid in the gaps, at least reduce if not eliminate the short circuits in the copper funnel and at least reduce if not eliminate the external mechanical forces on the segment walls thereby increasing the segments useful life. Such methods and systems for maintaining the insulation gaps between the copper segments of the orifice could include, among other means, providing a layer of insulating material for establishing a fixed minimum space between each segment; for insulating each segment from the next segment and applying a means over the top of the layer of the insulation material for filling uneven areas in the layer and for sealing the gaps between each segment.

SUMMARY OF THE INVENTION

In one of its broader features, the invention includes systems and methods for controlling the size of the gaps between segments in a cold wall induction guide tube mechanism. One system includes a cold wall induction guide tube mechanism comprising: a cold wall induction guide tube mechanism including a neck having an exit orifice, the mechanism including a plurality of copper segments having gaps therebetween; and means, operatively positioned between the gaps in the mechanism, for maintaining the size of the gaps between the segments such that electric insulation in the segments is established and maintained during electroslag refining operations.

Another feature of the invention includes a method for controlling the size of the gaps between segments in a cold wall induction guide tube mechanism comprising the steps of: providing a funnel shaped cold wall induction guide tube mechanism having a plurality of copper segments with gaps; providing a skull of melt in the funnel shaped cold wall induction guide tube mechanism; heating the interior of the lower neck portion of the funnel shaped mechanism; providing a reservoir of melt above the funnel shaped mechanism; providing a flow of melt to and down through the funnel shaped mechanism to form a stream of melt exiting the neck portion of the funnel shaped mechanism; establishing and maintaining insulation in the gaps between the segments such that electric insulation between the segments is effective during operation.

It is, accordingly, desirable to provide methods and systems for controlling the size of the gaps between segments in a cold wall induction guide tube mechanism.

Other features and advantages of the invention will be apparent from the following description, the accompanying drawings and the appended claims.

DETAILED DESCRIPTION OF THE INVENTION

As embodied by the invention, an electrode or ingot of metal to be refined is introduced directly into an electroslag refining apparatus for refining the metal and produce a melt of refined metal that is received and retained within a cold hearth apparatus mounted immediately below the electroslag refining apparatus. The molten metal is dispensed from the cold hearth through a cold finger orifice mounted directly below the cold hearth reservoir. The flow of melt from the cold finger apparatus is controlled by one or by a combination of mechanisms including thermal and electromechanical means.

If the rate of electroslag refining of metal and accordingly the rate of delivery of refined metal to a cold hearth approximates the rate at which molten metal is drained from the cold hearth through the cold finger orifice, a basically steady state operation is accomplished in the overall apparatus and the process can operate continuously for an extended period of time and, accordingly, can process a large bulk of unrefined metal to refined metal.

The processing described herein is applicable to a wide range of alloys that can be processed beneficially through the electroslag refining processing. Such alloys include nickel- and cobalt-based superalloys, zirconium and titanium-based alloys, and ferrous-based alloys, among others. The slag used in connection with such metals will vary with the metal being processed and will usually be the slag conventionally used with a particular metal in the conventional electroslag refining thereof.

The several processing techniques may be combined to produce a large body of refined metal because the ingot which can be processed through the combined electroslag refining and cold hearth and cold finger mechanism can be a relatively large supply ingot and can, accordingly, produce a continuous stream of metal exiting from the cold finger orifice over a prolonged period to deliver a large volume of molten metal.

Figure 1:
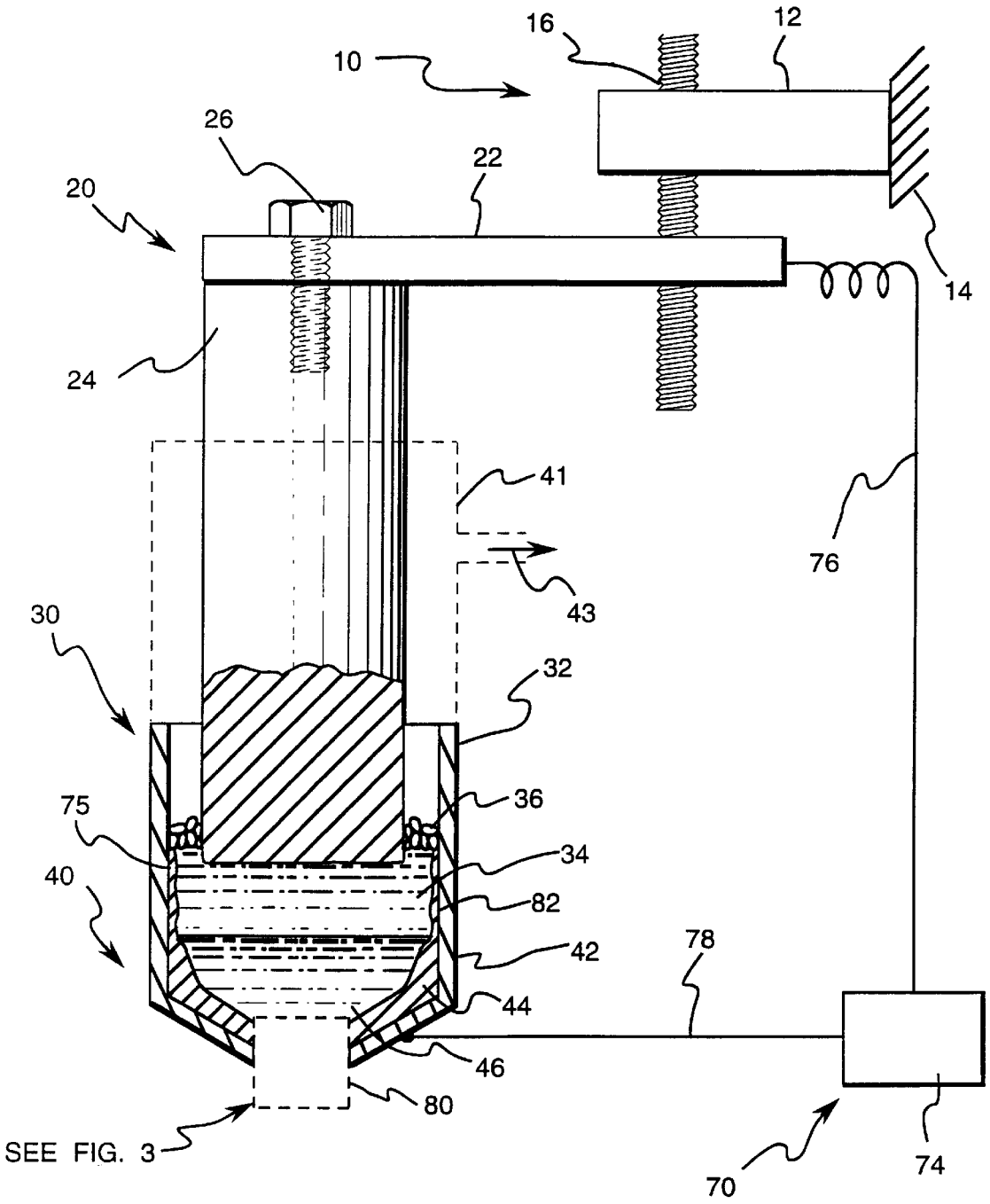
FIG. 1 is a semischematic vertical sectional view of a representative electroslag refining apparatus suitable for use with the present invention.
Figure 2:
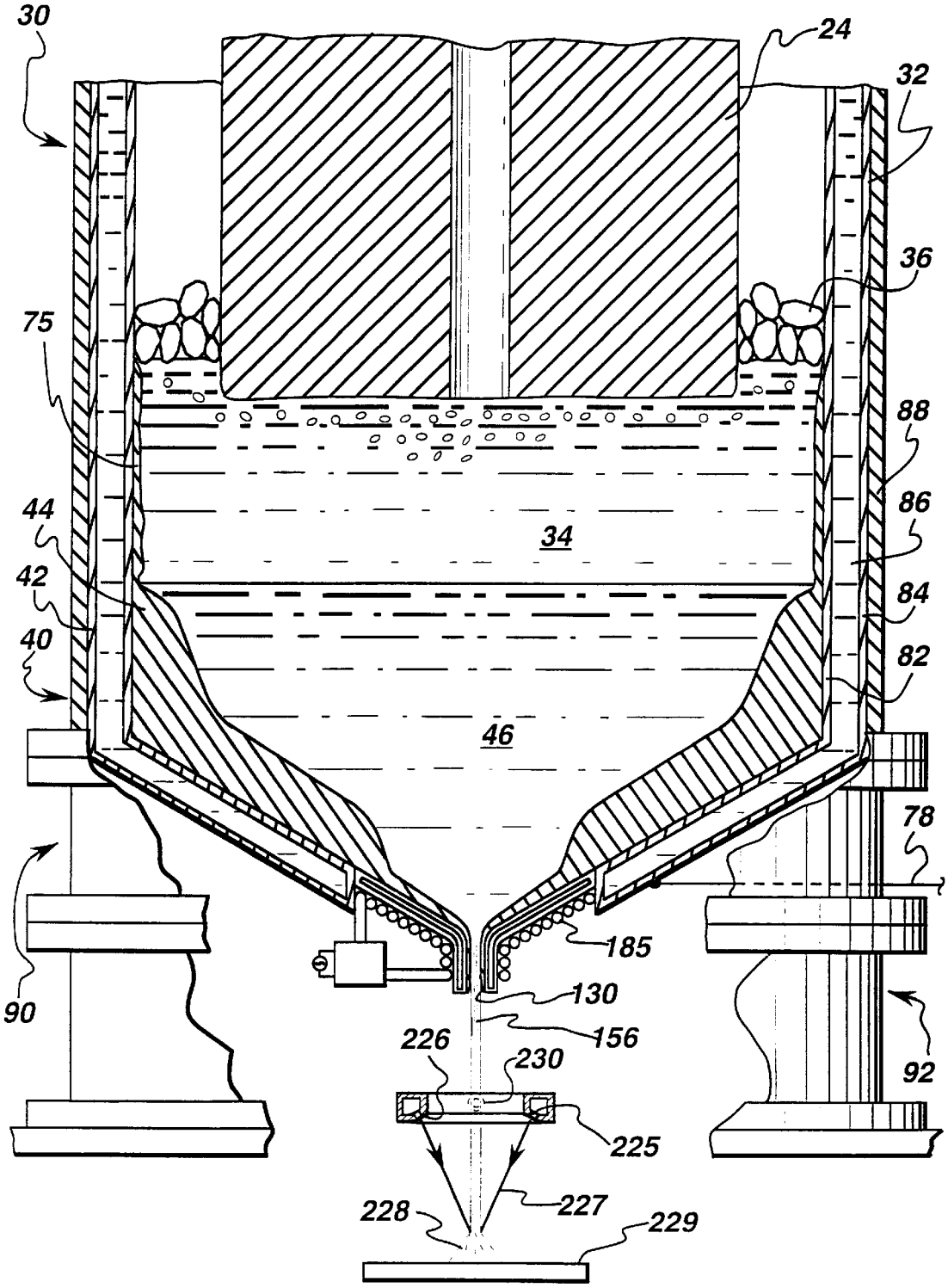
FIG. 2 is a semischematic vertical sectional representative illustration of the apparatus of FIG. 1 but showing structural details of the cold wall induction guide tube and the atomizer.

FIGS. 1 and 2 are semischematic elevational views in part in section of an apparatus for carrying out the electroslag refining and atomization features of the present invention. A vertical motion control apparatus 10 is shown schematically. It includes a structure 12 mounted to a vertical support 14 for containing a motor or other mechanism adapted to impart rotary motion to a member 16 for example, for illustrative purposes only, a screw or screw mechanism. An ingot support station 20 comprising means 22, such as, for illustrative purposes only, a bar, threadably engaged at one end to the member 16 and supporting the ingot 24 at the other end by conventional means 26, for example, for illustrative purposes only, a bolt. It being understood that the present illustration is representative in nature only and that in an industrial setting pneumatic, electronic and other well-known methods and apparatus would actually be used, as is known in the art.

An electroslag refining station 30 comprises a cooled, such as, for example, by water, reservoir 32 containing a molten slag 34, an excess of which is illustrated as solid slag granules 36. A skull of slag 75 may form along the inside surfaces of the inner wall 82 of vessel 32 due to the cooling influence of the cooling water flowing against the outside of inner wall 82.

A cold hearth station 40 is mounted immediately below the electroslag refining station 30 and includes a cooled, such as, for example, by water, hearth 42 containing a skull 44 of solidified refined metal and also a body 46 of liquid refined metal. Cooled reservoir 32 may be formed integrally with the cooled hearth 42.

The bottom dispensing structure (shown as an empty dashed box) 80 of the apparatus is provided in the form of a cold finger orifice. The cold hearth dispensing station 80 and the cold finger orifice will be explained more fully below.

Electric refining current is supplied by station 70. The station includes the electric power supply and control mechanism 74. It also includes the conductor 76 carrying current to the bar 22 and, in turn, to ingot 24. Conductor 78 carries current to the metal vessel wall 32 to complete the circuit of the electroslag refining mechanism.

As illustrated by FIG. 2, the station 30 is an electroslag refining station disposed in the upper portion 32 of the vessel and the cold hearth station 40 is disposed in the lower portion 42 of the vessel. The vessel is preferably a double walled vessel having an inner wall 82 and an outer wall 84. Between these two walls, a cooling liquid, such as, for example, water is provided, as is conventional practice with some cold hearth apparatus. The cooling liquid 86 may be flowed to and through the flow channel between the inner wall 82 and outer wall 84 from supply means and through conventional inlet and outlet means which are conventional and which are not illustrated in the figures. The use of cooling liquid 86 to provide cooling to the walls of the cold hearth station 40 is necessary in order to provide cooling at the inner wall 82 and thereby to cause the skull 44 to form on the inner surface of the cold hearth structure.

The cooling liquid 86 is not essential to the operation of the electroslag refining or to the upper portion of the electroslag refining station 30 but such cooling may be provided to ensure that the liquid metal 46 will not make contact with the inner wall 82 of the containment structure because the liquid metal 46 could attack the wall 82 and cause some dissolution therefrom to contaminate the liquid metal of body 46 within the cold hearth station 40. Also, in FIG. 2, a structural outer wall 88 is also illustrated. Such an outer wall may be made up of a number of flanged tubular sections 90, 92.

Figure 3:
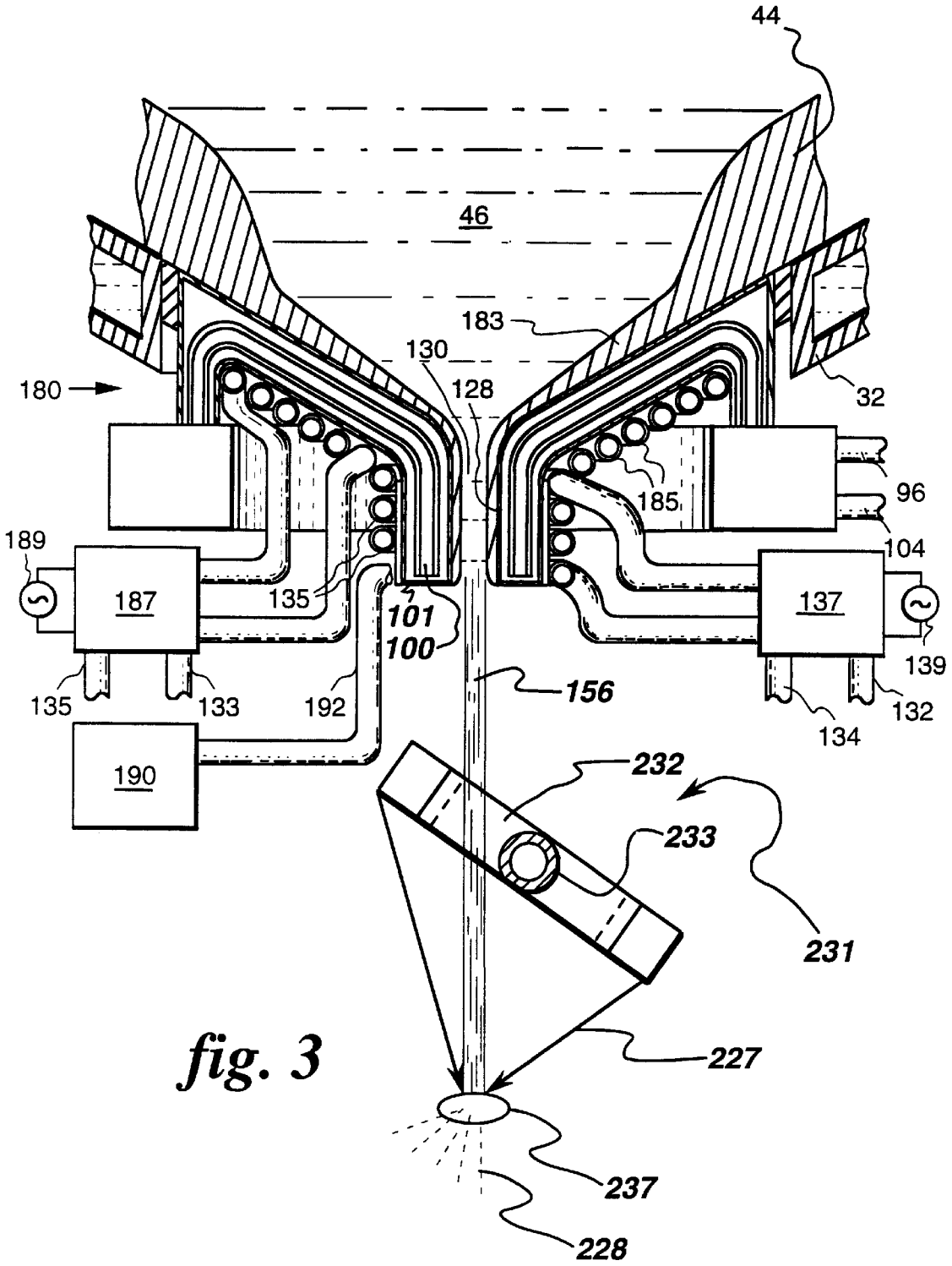
FIG. 3 is a semischematic vertical section in detail of the cold finger nozzle and atomizer of the structures of FIG. 2.
Figure 4:
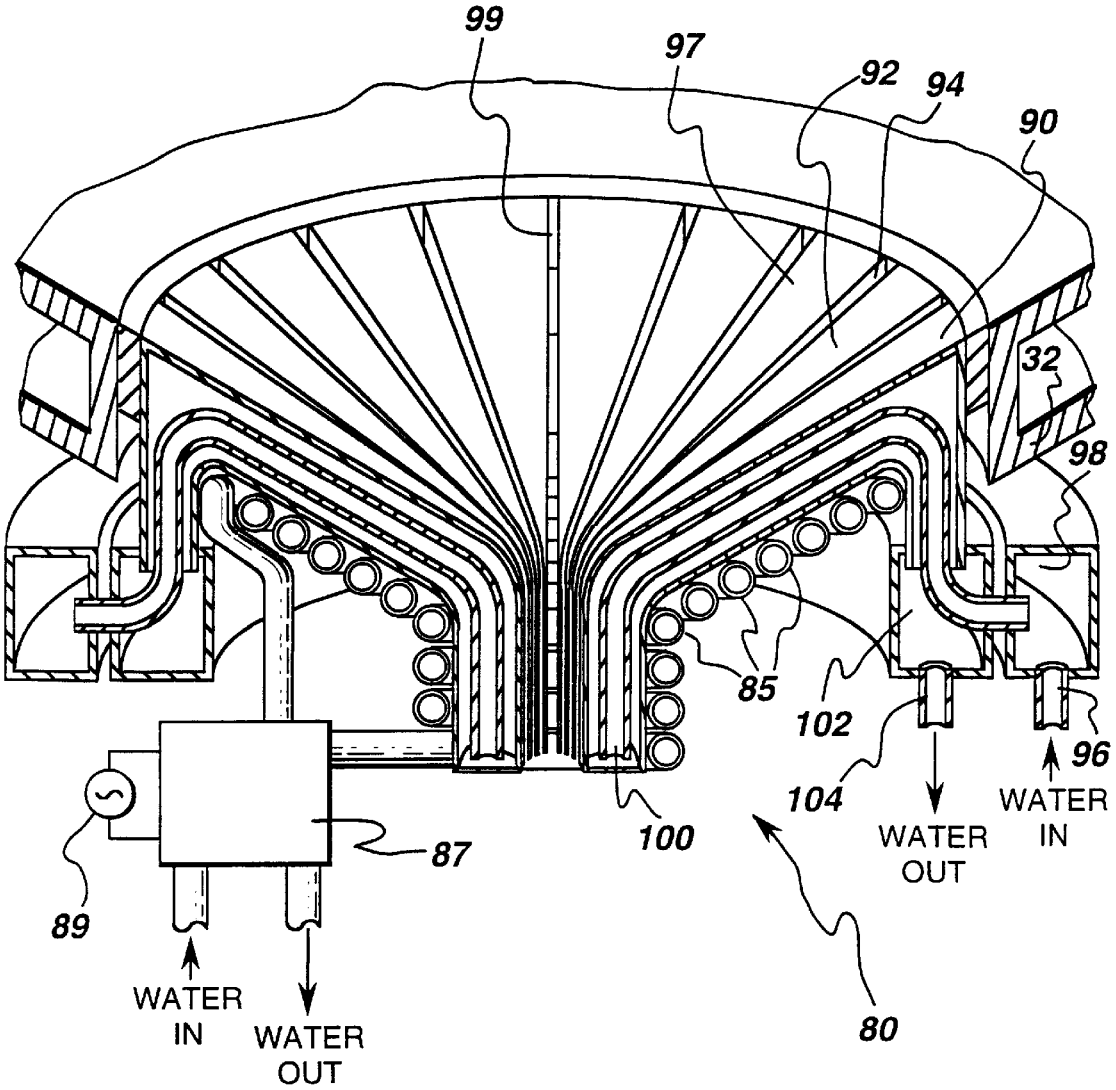
FIG. 4 is a semischematic illustration in part in section of the cold finger nozzle portion of an apparatus similar to that illustrated in FIG. 3 but showing the apparatus free of molten metal.

The cold finger structure is shown in detail in FIG. 3 in its relation to the processing of the metal from the cold hearth structure and the delivery of liquid melt 46 from the cold hearth station 40, as illustrated in FIGS. 1 and 2. FIG. 3 shows the cold finger with the solid metal skull and with the liquid metal reservoir in place. By contrast, FIG. 4 illustrates the cold finger structure without the liquid metal, or solid metal skull in order that more structural details may be provided and clarity of illustration may be achieved. Cold finger structures are not themselves novel structures and have been described in the literature (see for example the discussion in U.S. Pat. No. 5,348,566).

One structure useful in the present invention combines a cold hearth with a cold finger orifice so that the cold finger structure effectively forms part, and in the illustration of FIG. 3, the center lower part, of the cold hearth. This combination preserves the advantage of the cold hearth mechanism by permitting the purified alloy to form a skull, by its contact with the cold hearth, and thereby to serve as a container for the molten version of the same purified alloy. In addition, the cold finger orifice structure of station 180 of FIG. 3 is employed to provide a more controllable generally funnel shaped skull 183 and particularly of a smaller thickness on the inside surface of the cold finger structure. As is evident from FIG. 3, the thicker skull 44 in contact with the cold hearth and the thinner skull 183 in contact with the generally funnel shaped cold finger structure is basically continuous.

One reason why the skull 183 is thinner than skull 44 is that a controlled amount of heat may be put into the skull 183 and into the generally cone shaped portion of the liquid metal body 46 that is proximate the skull 183 by means of the induction heating coils 185. The induction heating coil 185 is cooled by flow of a cooling liquid, such as, for example, water through the coolant and power supply 187. Induction heating power supplied to the unit 187 from a power source 189 is shown schematically in FIG. 3.

One advantage of the cold finger construction of the structure of station 180 is that the heating effect of the induction energy penetrates through the cold finger structure and acts on the body of liquid metal 46 as well as on the skull structure 183 to apply heat thereto. This is one of the features of the cold finger structure and it depends on each of the fingers of the structure being insulated from the adjoining fingers by an air or gas gap or by an insulating material. Hence the term CIG or cold wall induction guide tube mechanism.

This arrangement is clearly illustrated in FIG. 4 where both the skull and the body of molten metal are omitted from the drawing for clarity of illustration. An individual copper cold finger segment 97, as shown in FIG. 4, is separated from the adjoining copper finger segment 92 by a gap 94, which may be provided with and filled with an insulating material such as a ceramic material or with an insulating gas. The molten metal held within the cold finger structure 80 does not leak out of the structure through the gaps such as 94 because the skull 82, as illustrated in FIG. 3, forms a bridge over the various cold fingers and prevents and avoids passage of liquid metal therethrough. As is evident from FIG. 4, all gaps extend down to the bottom of the cold finger structure. This is evident in FIG. 4 as gap 99 aligned with the line of sight of the viewer is shown to extend all the way to the bottom of cold finger structure 80. The actual gaps can be quite small and of the order of 20 to 50 mils so long as they provide good insulating separation of the fingers.

The details of the figure are fully disclosed in U.S. Pat. No. 5,348,566, assigned to the assignee of the present application, the disclosure of which is herein incorporated by reference.

Because it is possible to control the amount of heating and cooling passing from the induction coils 185 to and through the cold finger structure of station 180, it is possible to adjust the amount of heating or cooling which is provided through the cold finger structure both to the skull 183 as well as to the generally cone shaped portion of the body 46 of molten metal in contact with the skull 183.

As shown in FIG. 4, the individual fingers such as 90 and 92 of the cold finger structure are provided with a cooling fluid such as water by passing water into the receiving pipe 96 from a source not shown, and around through the manifold 98 to the individual cooling tubes such as 100. Water leaving the end of tube 100 flows back between the outside surface of tube 100 and the inside surface of finger 90 to be collected in manifold 102 and to pass out of the cold finger structure through water outlet tube 104. This arrangement of the individual cold finger water supply tubes such as 100 and the individual separated cold fingers such as 90 is basically the same for all of the fingers of the structure so that the cooling of the structure as a whole is achieved by passing water in through inlet pipe 96 and out through outlet pipe 104.

The net result of this action is best illustrated in FIG. 3 where a stream 156 of molten metal is shown exiting from the cold finger orifice structure. This flow is maintained when a desirable balance is achieved between the input of cooling water and the input of heating electric power to and through the induction heating coils 185 and 135.

The induction heating coils 85 of FIG. 4 show a single set of coils operating from a single power supply 87 supplied with power from the power source 89. In the structure of FIG. 3, two induction heating coils are employed, the first is placed adjacent the tapered portion of the funnel shaped cold finger device and supplies heat principally to the controllable skull 183. A power source 189 supplies power to power supply 187 and this power supply furnishes the power to the set of coils 185 positioned immediately beneath the tapered portion of the funnel shaped cold finger structure. A second power source 139 furnishes power to power supply 137 and power is supplied from the source 137 to a set of coils 135 which are positioned along the vertical down spout portion of the cold finger apparatus to permit a control of the flow of molten metal from bath 46 through the vertical portion of the cold finger apparatus.

An increase in the amount of induction heating through coil 135 (see FIG. 3) can cause a remitting of the solidified plug of metal in the vertical portion of the cold finger apparatus and a renewal of stream 156 of molten metal through passageway 130. When the stream 156 is stopped or slowed, there is a corresponding growth and thickness of the skull 128 in the vertical portion or neck of the funnel shaped cold finger apparatus.

The regulation of the amount of cooling water flowing to the cold finger apparatus itself as well as the flow of induction heating current through the coils 185 and 135 and particularly the coil 135 regulates the thickness of the thinner skull 128 and the thickness of skull 128 is one of several parameters which regulates the rate of flow of metal from the reservoir 46, thus having an effect on the gas to metal ratio during atomization prior to the spray forming of the perform.

A further increase in the amount of induction heating power through the coil 135 can cause a desired electromagnetic effect, namely the electromagnetic repulsion of the liquid metal stream away from the passageway 130. The electromagnetic restriction of the flow through the cold finger apparatus effectively results in an electromagnetic orifice that may be controlled and caused to fluctuate at high rates which in turn has the effect of enabling the flow rate of the stream therethrough to be rapidly varied, i.e. selectively increased or decreased. Thus, the power applied to the coil 135 has a direct influence on the rate of flow of metal from the reservoir 46, thus having a direct effect on the gas to metal ratio during atomization and subsequently on the spray 228 impacting the preform 229.

As mentioned above, when the rate of flow of metal from the cold hearth station 40 through the cold finger mechanism 180 is selectively increased or reduced, it is necessary to also increase or reduce the flow of the refining current passing through the body of refined metal 46 as well as through the slag 34 and through the electrode 24. Such reduction in refining current has the effect of reducing the rate of melting of the electrode 24 at the upper surface of the slag 34 and in this way reducing the rate at which metal accumulates in the cold hearth 40.

When the flow rate of stream 156 is increased, decreased or brought to a stop, such as, for example, through the enlargement of the thickness of the skull 128 in the vertical neck portion of the cold finger apparatus, the liquid metal 46 in the cold hearth, as well as the liquid slag 34 in the slag station, can be kept molten by selectively adjusting a current through the apparatus, in coordination with the requirements for the spray for the preform. However, when the stream is stopped, a sufficiently lower level of current is required, such that the reservoir 46 of molten metal remains molten and the slag bath 34 remains molten but the melting of the electrode at the upper surface of the slag bath 34 proceeds at a very low or negligible level so that the level of molten metal in cold hearth station 40 does not excessively build up.

In operation, as illustrated in FIG. 1, the ingot 24 of unrefined metal is processed in a single pass through the electroslag refining and related apparatus and through the cold hearth station 40 to form a continuous stream 156 of refined metal. The stream 156 formed by the processing is a stream of refined metal free of the oxide, sulfide and other impurities that can be removed by the electroslag refining of station 30.

Depending on the application for the electroslag refining apparatus, there is a need to control the rate at which a metal stream 156 is removed from the cold finger orifice structure 130. The rate at which such a stream of molten metal is drained from the cold hearth through the cold finger structure 180 is, at least partially, controlled by the cross-sectional area of the orifice 130 and by the hydrostatic head of liquid above the orifice. This hydrostatic head is the result of the column of liquid metal and of liquid slag that extends above the orifice of the cold finger structure 180. The flow rate of liquid from the cold finger orifice or nozzle has been determined experimentally for a cylindrical orifice.

One of the features of the ESR/CIG melting system is the copper, funnel shaped cold finger structure 80 that forms the cold-walled-induction guide. The copper funnel shaped structure is made of several copper segments that result from slotting an otherwise axisymmetric copper funnel. These slots 94, 99 are added, among other reasons, to allow penetration of the electric field through the copper funnel shaped structure and into the liquid metal 46 within the funnel shaped structure 80.

The embodiment of the copper, funnel shaped cold finger structures illustrated in FIGS. 3 and 4 relies on gaps or air-gaps between the copper segments to provide for electric isolation between segments. If the gaps or air-gaps are not maintained, arcing between the copper segments 92, 97 may occur, shortening their life and decreasing the effectiveness of the induction heating system that includes heaters 135, 185 that has been shown experimentally to be the case.

During operation of the system, movement of the individual copper segments, 92, 97 resulting from mechanical and thermal forces can occur, allowing liquid metal to flow between the copper segments where it solidifies as "fins". In addition to short-circuiting the gaps 94, 99, the "fins" have been found to apply extreme mechanical force to the vertical walls of the copper segments 92, 97, further decreasing the useful life of the segments.

In general, a steady state is desired in which the rate of metal melted and entering the refining station 30 as a liquid is equal to the rate at which liquid metal is removed as a stream 156 (see FIG. 3) through the cold finger structure and provided to the atomizer 231 for atomization into spray to be formed into a preform. Slight adjustments to increase or decrease the rate of melting of metal are made by adjusting the power delivered to the refining vessel from a power supply such as 74. Also, in order to establish and maintain a steady state of operation of the apparatus, the ingot must be maintained in contact with the upper surface of the body of molten slag 34 and the rate of descent of the ingot into contact with the melt must be adjusted through control means within box 12 to ensure that touching contact of the lower surface of the ingot with the upper surface of the molten slag 34 is maintained.

The deep melt pool 46 within cold hearth station 40 is an advantage in the electroslag refining because a specific flow rate can be established from the reservoir of melt 46 through the flow path 130 (see FIG. 3) from the cold finger apparatus 180.

Generally, control or stoppage of the flow through passageway 130 is accomplished by supplying or withdrawing heat from the melt and basically increasing or decreasing the size of the skull 128 in the passage way 130 with stoppage occurring with the freezing the metal within the passageway 130. In supplying or withdrawing heat from the melt, it will be appreciated that there are basically two sources of heat for the metal within passageway 130. One source is heat that is generated in the metal by operation of the coils 135 and 185. The second source is the heat within the melt itself as it flows down from reservoir 46. Although it is possible to stop heating the melt in passageway 130 by stopping the supply of power from power source 137 the metal will remain molten because molten metal is flowing down reservoir 46 to passageway 130 and brings with it the heat of fusion and a degree of superheat already present in the melt.

There are also a number of ways in which heat is removed from melt in passageway 130. A primary source of heat removal and the one that causes the skull 128 to remain in place is the cooling accomplished by flow of water in the cold fingers, such as 100. It is possible to increase or reduce the rate of cooling water flow through the cold fingers in order to increase or decrease the size of the skull 128. Such increase or decrease in the size of the skull 128 will increase or decrease the flow rate of molten metal delivered to the atomization zone. Thus, one method of controlling the gas to metal ratio is to control the size of the skull 128 in passageway 130 to increase or decrease the flow rate of molten metal delivered to the atomization zone 237.

An additional method for controlling the size of the skull 183 is to provide a source 190 of cold gas, such as, for example, via a gas supply pipe 192, for directing the gas against the bottom surface 101 of the cold finger apparatus 180. It is well known that high pressure gas will expand as it leaves the end of pipe 192 and will become spontaneously cooled to low temperatures of about minus 200 degrees centigrade or lower. Such high pressure gas cooling of the neck of the CIG structure can be very effective in rapidly removing heat from the structure and controlling the size of the skull 128 in passageway 130 to increase or decrease and thus increase or decrease the flow rate of molten metal delivered to the atomization zone or for causing a freeze up of melt in the passageway 130.

There are accordingly a number of ways in which heat can be removed from molten metal in passageway 130 in order to solidify or freeze metal in the passageway and to control or block further flow through the passageway. Depending on the hydrostatic head within the cold hearth 40 and the hydrostatic head of slag in the station 30, there will be greater or smaller tendency for metal to continue flowing through passageway 130. Where the hydrostatic head is relatively small, an increase or decrease in the size of the skull 183 in passageway 130 or the complete blockage of passageway 130 can be achieved simply by increasing or decreasing heat through a combined manipulation of the induction heating from power unit 137 and adjusting the rate of ingot melting and, accordingly, the rate of introduction of metal into the refining vessel by controlling the level of power supply to the vessel.

Where the hydrostatic head is higher, one way in which the flow of metal through passageway 130 can be controlled is by placing a negative pressure on the electroslag refining station and the cold hearth station 40. This may be accomplished, as indicated in FIG. 1, by providing an enclosure, such as enclosure 41 shown in phantom above station 30, and exhausting gas from the enclosed structure in the direction of arrow 43. In general, the hydrostatic head above the flow path 130 is lower when a run is completed and the hydrostatic head is at a lower value so that the application of relatively small negative pressure in the enclosure 41 can reduce the flow through passageway 130 and permit the cooling to control the size of the passageway 130 or to cause a freeze-up or blockage of the passageway 130.

It will be appreciated that the heat regulating means, as discussed above, can be used in combinations, such as, for example, in conjunction with a processor or computer, for controlling the size of the passageway 130 and, subsequently, for controlling the flow rate of the metal stream delivered to the atomization zone 237.

When either an increase or a decrease in the flow rate of molten metal or restart of the flow of metal within the passageway 130 is desired, the cooling is appropriately increased or reduced, induction heating through coil 135 is appropriately increased or reduced in order to control the size of the passageway 130 and is coordinated with the power provided to the ingot to control the hydrostatic head.

At the lowermost part of vessel 32 a controlled drain orifice 130 communicates with molten metal pool 46. A stream of molten metal 156 is caused to flow from orifice 130 through a spray forming atomizer 231. In one form, atomizer 231 comprises a hollow circular atomizer manifold with a central circular aperture 232 that is concentrically positioned to receive metal stream 156 therethrough. Atomizer 231 also includes a peripheral row of gas jets or orifices 225 in a peripherally continuous tapered or conical edge surface 226. Atomizer 231 is connected to a source (not shown) of an inert gas under pressure, and the combination of the gas jet orifices 225 and conical surface 226 provides a plurality of gas streams 227 that converge at a downstream apex on the passing metal stream 156. The controlled interaction of the gas jet streams 227 with metal stream 156 causes metal stream 156 to break down and be converted to an expanding spray plume or pattern 228 of small molten metal droplets.

Spray pattern 228 is directed against a collector or preform 229 to provide, for example, a billet of refined ingot metal or other ingot metal objects. Collector 229 may be a fixed or moving surface including a rotating surface such as the surface of a rotating cylinder or mandrel. The efficiency and effectiveness of deposition of molten metal spray 228 on a collector surface to provide a refined metal object is facilitated and improved when the spray pattern 228 may be angularly adjusted with respect to the collector. Angular adjustment also leads to improved density and microstructure of the refined metal product. Continuous and repetitive angular adjustment may also be utilized to provide an oscillating or scanning motion of the atomizer 231.

In order to provide angular adjustment, atomizer 231 may be mounted for angular adjustment rotation about a transverse axis so that the plane of the atomizer is not perpendicular to the metal stream 156. Also, by mounting atomizer 231 for angular adjustment rotation, the defined spray pattern 228 may be more advantageously matched to different surface configurations of collector or preform 229 as compared to a non-adjustable atomizer where the spray pattern is fixedly directed to a limited area of the collector, a condition which may require a complex adjustable mounting of a collector that, for example, may weigh from about 50 lbs. to about 15 tons.

In the past, there have been definite limits to the degree of angular adjustment of atomizer 231. For example, metal stream 156 is a smooth cohesive stream passing concentrically through a circular atomizer 231 with a predetermined atomizer clearance with respect to overall structure of atomizer 231 and its operating characteristics including the use of gas jets from orifices 225 or projecting nozzles.

In a recently issued patent, U.S. Pat. No. 5,366,206, the disclosure of which is hereby incorporated by reference, the spray 228 forming atomizer 231, disclosed therein, had a defined aperture elongated and non-circular such as an elliptical or oval configuration. An elongated, ovate, or elliptical aperture provides an extended range of angular adjustment of an atomizer 231 while maintaining a satisfactory central aperture exposure for the passing metal stream 156 during spray forming.

Figure 5:
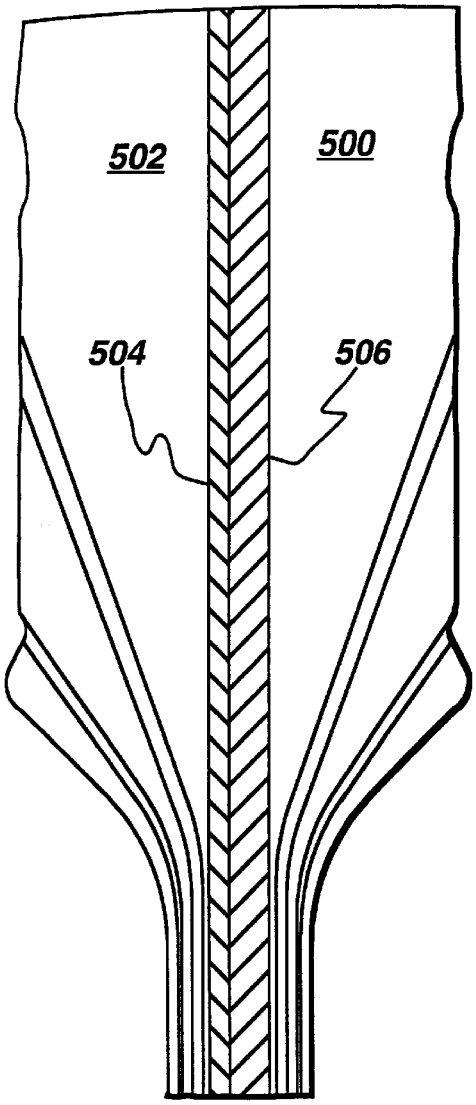
FIG. 5*a* is an enlarged view of the gap between copper segments filled with a separate insulator means and a separate sealing means.
FIG. 5*b* is an enlarged view of the gap between copper segments filled with a composite/epoxy insulator and sealing means.
Figure 6:
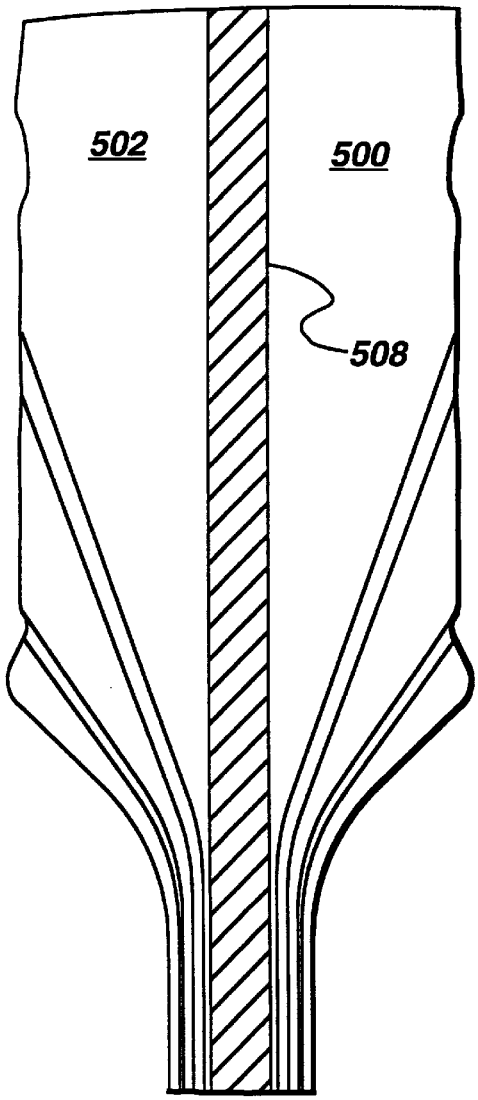

As shown in FIGS. 5 and 6, to ensure that proper spacing is maintained between the copper segments 500, 502 during operation, the following has been found to be effective: Placing a thin layer about 0.004 to about 0.010 inch of insulation means 504, such as for example, fiber glass cloth or Kapton tape between each copper segment for establishing a fixed minimum spacing between each copper segment and for insulating each copper segment from the next segment; and applying a layer nominally about 1/16 inch thick of sealing means 506, such as, for example but not limited to, GE Silicone RTV 106 high temperature silicone rubber, beside the tape or cloth and then spreading the silicone rubber evenly along the side walls of each copper segment. Accordingly, insulation means and sealing means, as embodied by the invention, are separate and different physical features, applied separately and maintaining distinct and separate characteristics.

The sealing means, such as but not limited to GE Silicone RTV 106, possesses a tensile strength, elongation and other physical characteristics that provide desirable sealing results, enabling movement of the respective segments while ensuring a sealed system. Also, the sealing means, such as but not limited to GE Silicone RTV 106, provides a contained sealed relationship between the copper segments 500, 502, even when there is movement of the copper segments 500, 502 during operation of the system, arising for example from thermal and mechanical forces.

Further, the contained sealed relationship between the copper segments 500, 502 is maintained throughout operation of the system. For example, GE Silicone RTV 106 possesses a tensile strength of about 26 kg/cm$^2$ and an elongation percentage of about 400. These physical characteristics of GE Silicone RTV 106 provide superior sealing characteristics and permit relative movement of the copper segments 500 and 502, without impairing the sealed nature and operability of the system, as embodied by the invention. The elasticity of the sealing means, such as but not limited to GE Silicone RTV 106, permits the system to remain sealed at gaps between the segments. Other physical properties of the sealing means, including but not limited to the thermal properties, coefficients of expansion, other mechanical properties and the like further enable a system with sealing means and insulating means, as embodied by the invention, to provide enhanced performance with respect to known systems.

For example, in direct contrast to the invention, a system without insulation means and sealing means, as embodied by the invention, will not exhibit the resilient sealing nature, as in the invention. Further, a system without insulation means and sealing means, as embodied by the invention, will not permit use with movement of the segments, as enabled by the insulation means and sealing means, as embodied by the invention. Therefore, such a system, without the insulation means and sealing means, as embodied by the invention, will be susceptible to at least one of leakage and possible physical failure at the gaps.

It has been found that these materials fill in any uneven areas or defects from previous operation and effectively seal the gaps between each copper segment. After securing the gaps between the copper segments in position, excess silicone rubber material can be removed, prior to operation. During operation the silicone rubber is kept cool by the adjacent water-cooled copper segments.

It is believed that paper, cotton, silk, glass fiber, mica, asbestos, etc. when coated with a suitable dielectric material, would be possible alternative materials for the fiber glass cloth or kapton tape mentioned above. It is also believed that silicone, epoxy, rubber, thermoplastic or thermosets, nylon, polycarbonate, etc. would be possible alternative materials for the GE Silicone RTV 106 high temperature silicone rubber mentioned above.

It is further believed that alternatively a single layer fiber glass epoxy composite 508, as illustrated in FIG. 6, could be substituted for the multiple material insulation and sealing process above. This could be accomplished by placing the fiber glass in the gap first and then applying the epoxy by vacuum impregnation.

It is also further believed that alternatively an epoxy could be substituted for the multiple material insulation and sealing process above. This could be accomplished by applying the epoxy by vacuum impregnation.

Because it is possible to control the amount of heating and cooling passing from the induction coils 185 to and through the cold finger structure of station 180, it is possible to adjust the amount of heating or cooling which is provided through the cold finger structure both to the skull 183 as well as to the generally cone shaped portion of the body 46 of molten metal in contact with the skull 183.

As shown in FIG. 4, the individual fingers such as 90 and 92 of the cold finger structure are provided with a cooling fluid such as water by passing water into the receiving pipe 96 from a source not shown, and around through the manifold 98 to the individual cooling tubes such as 100. Water leaving the end of tube 100 flows back between the outside surface of tube 100 and the inside surface of finger 90 to be collected in manifold 102 and to pass out of the cold finger structure through water outlet tube 104. This arrangement of the individual cold finger water supply tubes such as 100 and the individual separated cold fingers such as 90 is basically the same for all of the fingers of the structure so that the cooling of the structure as a whole is achieved by passing water in through inlet pipe 96 and out through outlet pipe 104.

The net result of this action is best illustrated in FIG. 3 where a stream 156 of molten metal is shown exiting from the cold finger orifice structure. This flow is maintained when a desirable balance is achieved between the input of cooling water and the input of heating electric power to and through the induction heating coils 185 and 135.

The induction heating coils 85 of FIG. 4 show a single set of coils operating from a single power supply 87 supplied with power from the power source 89. In the structure of FIG. 3, two induction heating coils are employed, the first is placed adjacent the tapered portion of the funnel shaped cold finger device and supplies heat principally to the controllable skull 183. A power source 189 supplies power to power supply 187 and this power supply furnishes the power to the set of coils 185 positioned immediately beneath the tapered portion of the funnel shaped cold finger structure. A second power source 139 furnishes power to power supply 137 and power is supplied from the source 137 to a set of coils 135 which are positioned along the vertical down spout portion of the cold finger apparatus to permit a control of the flow of molten metal from bath 46 through the vertical portion of the cold finger apparatus.

An increase in the amount of induction heating through coil 135 (see FIG. 3) can cause a remelting of the solidified plug of metal in the vertical portion of the cold finger apparatus and a renewal of stream 156 of molten metal through passageway 130. When the stream 156 is stopped or slowed, there is a corresponding growth and thickness of the skull 128 in the vertical portion or neck of the funnel shaped cold finger apparatus.

The regulation of the amount of cooling water flowing to the cold finger apparatus itself as well as the flow of induction heating current through the coils 185 and 135 and particularly the coil 135 regulates the thickness of the thinner skull 128 and the thickness of skull 128 is one of several parameters which regulates the rate of flow of metal from the reservoir 46.

Details of the spray forming of a preform including systems and methods for controlling the molten metal flow rate are contained in U.S. Application Ser. No. 08/537,963, filed Oct. 2, 1996, and assigned to the assignee of the present invention, the disclosure is herein incorporated by reference.

While the methods and systems contained herein constitute preferred embodiments of the invention, it is to be understood that the invention is not limited to these precise methods and systems, and that changes may be made therein without departing from the scope of the invention which is defined in the appended claims.

What is claimed is:

1. A system for spray forming a preform comprising:

a cold wall induction guide tube mechanism including an orifice having a diameter;

reservoir of melt operatively connected to the mechanism;

stream of melt exiting the orifice;

a skull of melt operatively formed in the cold wall induction guide tube mechanism, the mechanism comprising:

a plurality of copper segments having gaps therebetween, the gaps having a layer of about 0.004 to about 0.010 inch thick insulation means positioned between each segment and about 1/16 inch thick sealing means positioned in the gap with the insulation means, wherein the insulation means and sealing means maintain the size of the gaps between the segments such that electric insulation in the segments is established and maintained during electroslag refining operations;

preform means, operatively positioned below the orifice and an atomizer, operatively positioned between the orifice and the preform means, for atomizing the melt into metal spray.

2. The system according to claim 1, wherein the insulation means is separate from the sealing means.

3. The system according to claim 2, wherein the insulation means is a distinct and different element from the sealing means.

4. The system according to claim 1, wherein the sealing means comprises silicone.

5. An electroslag refining assembly including a reservoir of molten metal and an exit orifice in the reservoir through which a molten metal stream exits from the reservoir:

a cold wall induction guide tube means comprising a plurality of copper segments having gaps therebetween, the gaps having a layer of insulation means and a layer of sealing means positioned in each gap, wherein the insulation means and sealing means maintain the size of the gaps between the segments such that electric insulation in the segments is established and maintained during electroslag refining operations, induction coil means for induction heating of the mechanism;

a reservoir of melt operatively positioned relative to the mechanism;

a skull of melt in the mechanism;

a stream of the melt exiting the bottom of the mechanism;

a spray forming atomizer, operatively positioned relative the exit orifice, for generating a spray pattern of metal droplets; and means, operatively connected to the spray forming atomizer and a gas supply means, for directing the spray pattern of metal droplets toward a preform.

6. The system according to claim 5, wherein the insulation means is separate from the sealing means.

7. The system according to claim 5, wherein the insulation means is a distinct and different element from the sealing means.

8. The system according to claim 5, wherein the sealing means comprises silicone.

* * * * *